United States Patent [19]

Lauro et al.

[11] Patent Number: 4,850,427

[45] Date of Patent: Jul. 25, 1989

[54] DEVICE FOR CONTROLLING OVERHEATING AND SCALING IN AN APPARATUS FOR HEATING A FLUID AND APPARATUS EQUIPPED WITH SUCH A DEVICE

[75] Inventors: Fernand Lauro, Grenoble; Christophe Marvillet, Saint Egreve; Patrick Mayoussier, Eybens; Michel Amandjules, Pledran; Jean-Michel Porcher, Rambouillet, all of France

[73] Assignees: Commissariat A L'Energie Atomique; Chaffoteaux Et Maury, both of Paris, France

[21] Appl. No.: 131,671

[22] Filed: Dec. 11, 1987

[30] Foreign Application Priority Data

Dec. 24, 1986 [FR] France ..... 86 18169

[51] Int. Cl.[4] ..... F28F 19/00

[52] U.S. Cl. ..... 165/134.1; 122/406 R; 122/504; 126/350 R

[58] Field of Search ..... 122/504, 406 R; 165/134.1; 237/65, 66; 236/20 R; 126/350 R

[56] References Cited

U.S. PATENT DOCUMENTS 2,790,606 4/1957 Morgan et al. ..... 237/66
3,349,755 10/1967 Miller ..... 126/350 R

FOREIGN PATENT DOCUMENTS 2249691 4/1974 Fed. Rep. of Germany ..... 237/66
1458528 10/1966 France .

*Primary Examiner*—Albert W. Davis, Jr.
*Attorney, Agent, or Firm*—James E. Nilles; Donald C. McGaughey

[57] ABSTRACT

An overheating and scaling control device for a fluid heating apparatus, such as a domestic water heater, removes the hot fluid in the heater when demand ceases. A piston (46) mobile within a case (28) separates the latter into two compartments (32, 36) respectively connected to the cold water supply pipe (16) and to the hot water discharge pipe (22). In operation, the pressure in pipe (16) is higher than the pressure in pipe (22) and piston (46) is moved to the left. On stopping, the pressures are equal in both pipes and spring (40) moves piston (46) to the right. Cold water is fed into the exchanger tube (20), so that the hot water contained in the latter is discharged into pipe (38) and compartment (36).

8 Claims, 4 Drawing Sheets

DEVICE FOR CONTROLLING OVERHEATING AND SCALING IN AN APPARATUS FOR HEATING A FLUID AND APPARATUS EQUIPPED WITH SUCH A DEVICE

DESCRIPTION

The present invention relates to a device for controlling overheating and scaling for a fluid heating apparatus, essentially used for reducing overheating and scaling. The invention has a particularly interesting application in the case where said heating apparatus is a domestic water heater or a gas boiler.

Figure 1:
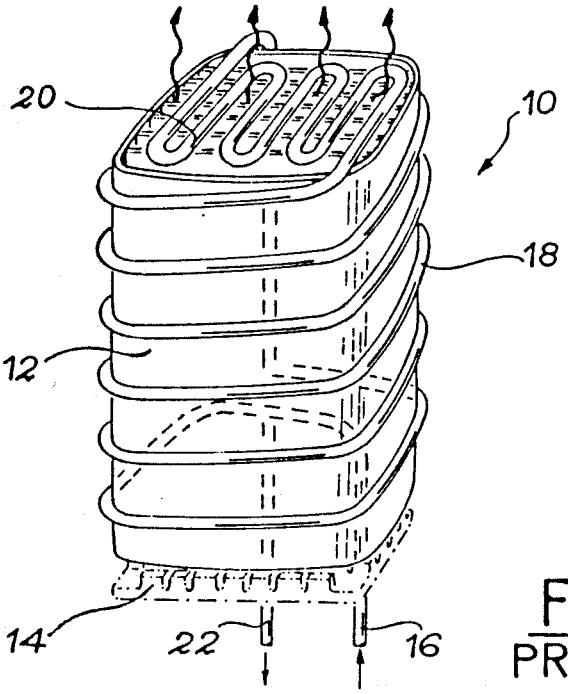
FIG. 1 PRIOR ART

The attached FIG. 1 is a perspective view of a presently used domestic water heater called a "wet chamber" water heater. This water heater 10 essentially comprises a metal, e.g. copper tank 12 positioned vertically and open at its lower and upper ends, thus defining a combustion chamber. A group of gas burners 14 is located beneath the tank and the burnt gases circulate from bottom to top within the latter. The cold water arrives through a supply pipe 16 and then flows along a coil 18 placed against the wall of tank 12, but outside the latter. Thus, the water starts to heat on flowing in the coil 18 and then enters an exchanger tube 20 located in the upper part of the tank, in the area where the burnt gases escape. The water which has been preheated in coil 18 is heated to the desired temperature in exchanger 20. The hot water is then distributed towards user devices by means of a pipe 22.

Figure 2:
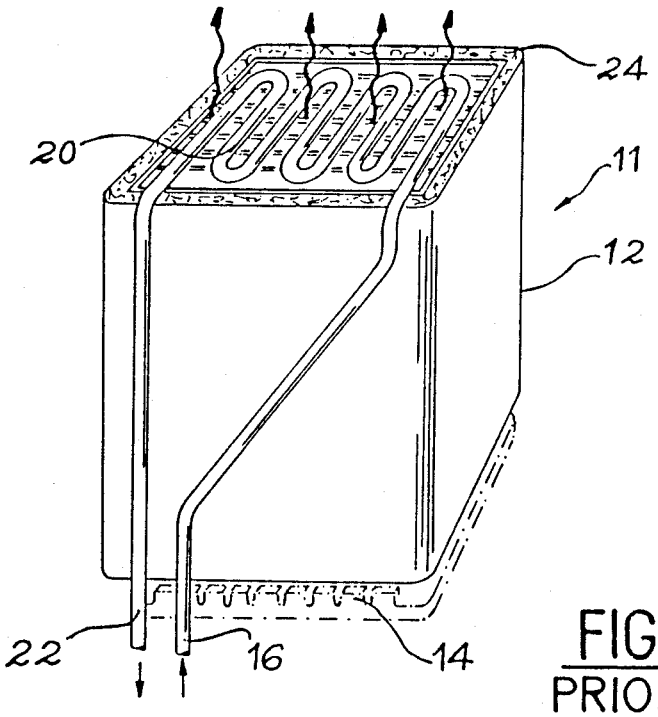
FIG. 2 PRIOR ART

Recently a new type of water heater has appeared, like water heater 11 illustrated in FIG. 2 and which is called a "dry chamber" water heater. As in the case of FIG. 1, there is a vertically positioned metal tank 12 open at its upper and lower ends, as well as a group of gas burners 14 in the lower part of the tank. There is a cold water supply pipe 16 and the hot water discharge pipe 22, but no coil is placed against the tank wall. The tank is equipped with an insulating mass 24 placed against its inner face and pipe 16 issues directly into the exchanger tube 20 positioned at the top of the tank where the burnt gases escape. Compared with the device according to FIG. 1, that illustrated in FIG. 2 has the advantage of a simpler apparatus concept and therefore a lower installation cost, whilst material savings are made due to the elimination of coil 18.

However, in both cases, these apparatuses suffer from a disadvantage, namely the overheating of the water during the starting up of the apparatus. It is pointed out that the flow of water into exchanger 20, i.e. the opening and closing of the shutoff valve (not shown in FIGS. 1 and 2), which controls the starting or stopping of the water heater. During operation, the water contained in exchanger 20 is at an average temperature higher by 20° C. than the cold water temperature. On closing the shutoff valve, the water remaining in the exchanger stores the heat radiated by the hot walls of the combustion chamber and that restored by the hot mass of the exchanger. Thus, after stopping for several dozen seconds, the water can reach a maximum temperature close to 100° C.

Thus, if the apparatus is put back into operation a short time after the previous stoppage, the temperature of the hot water leaving the same reaches very high values and risks exceeding the values fixed by standards in force. For example, in France, standard NF D 35-322, which is applicable to water heaters, bath heaters, etc., stipulates that as the apparatus is regulated to its nominal calorific flow and to a water flow corresponding to a temperature rise of 50° C., the temperature rise at the start of each drawing off must not exceed by more than 20° C. said regime value. With existing apparatuses and particularly dry chamber water heaters like that illustrated in FIG. 2, this value is often exceeded and to within a few degrees can reach the boiling point of water, which is clearly inadmissible.

The present invention aims at obviating these disadvantages by proposing a device for controlling overheating and scale formation for a fluid heating apparatus, such as a water heater, bath heater, gas boiler, etc.

In known manner, such an apparatus comprises a cold fluid supply pipe, a hot fluid discharge pipe, an exchanger communicating on the one hand with said cold fluid supply pipe and on the other with said hot fluid discharge pipe, the fluid circulating when the apparatus is in operation from the supply pipe to the discharge pipe through the exchanger and means for heating the fluid in the exchanger.

According to the main feature of the overheating and scaling control device according to the invention, it has a variable volume enclosure communicating with the cold fluid supply pipe, said enclosure being at least partly limited by a displaceable element having a first face subject to the pressure prevailing in the cold fluid supply pipe and a second face subject to a reference pressure, said element being displaceable under the effect of the pressure difference between these two faces.

The displaceable element can either be constituted by a deformable diaphragm, or by a piston mobile within a case. In the first case part of the cold fluid supply pipe can be made from a flexible material, said material constituting the deformable membrane or diaphragm. In this case, this part of the cold fluid supply pipe constitutes the variable volume enclosure.

In a first embodiment of the invention, the second face of the displaceable element is subject to the pressure prevailing in the hot fluid discharge pipe. In another embodiment, which relates to the case where the hot fluid discharge pipe is directly linked with the atmosphere, the second face of the displaceable element is exposed to atmospheric pressure.

In cases other than that where part of the cold fluid supply pipe is made from a flexible material, means are required for displacing the displaceable element in such a way as to move the liquid contained in said variable volume enclosure into the exchanger, so as to prevent overheating of the liquid and scaling of the exchanger. Preferably, use is made of a spring, as will be described hereinafter.

Finally, the invention also relates to an apparatus for heating a fluid equipped with an overheating and scaling control device as described hereinbefore.

The invention is described in greater detail hereinafter relative to non-limitative embodiments and the attached drawings, wherein show:

FIG. 1 A diagrammatic perspective view of a first type of water heater according to the prior art.

FIG. 2 A view similar to FIG. 1 illustrating a second type of prior art water heater.

Figure 3A:
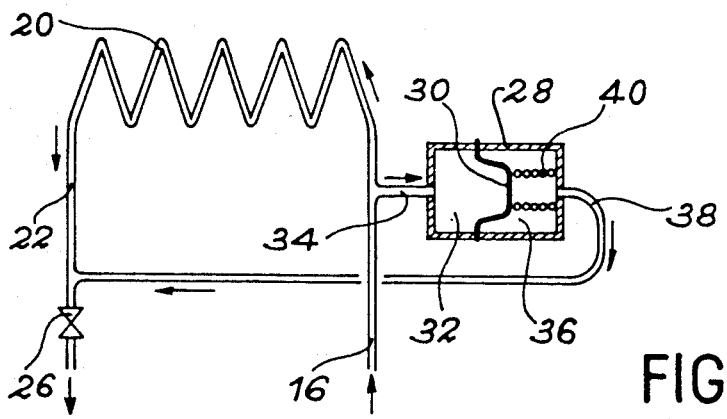
Figure 3B:
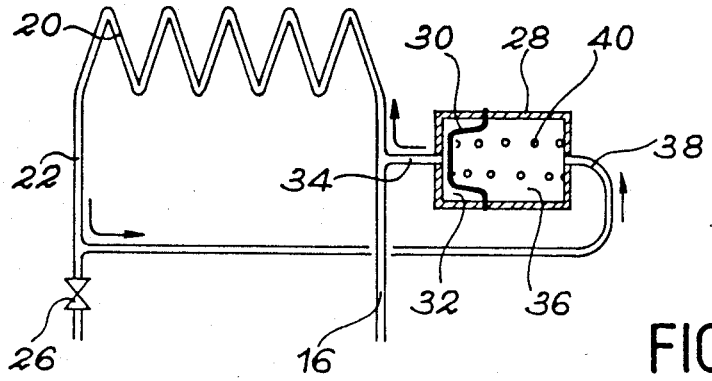

FIGS. 3*a* and 3*b* Simplified diagrams illustrating the operation of a device according to the invention, in the case where the displaceable element is a deformable diaphragm and where the second face thereof is subject to the pressure prevailing in the hot fluid discharge pipe.

Figure 4:
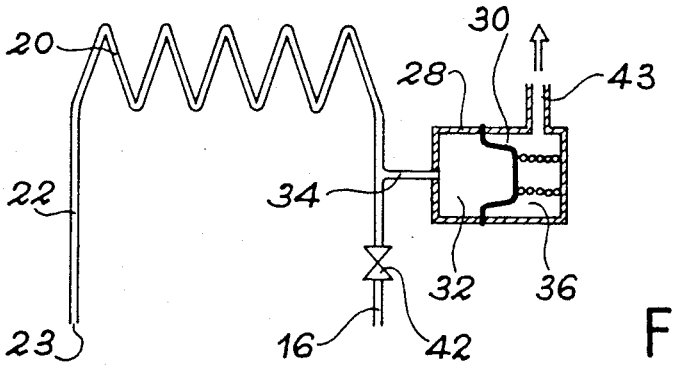

FIG. 4 A diagrammatic view similar to FIG. 3*a* in the case where the second face of the deformable diaphragm is subject to atmospheric pressure.

Figure 5:
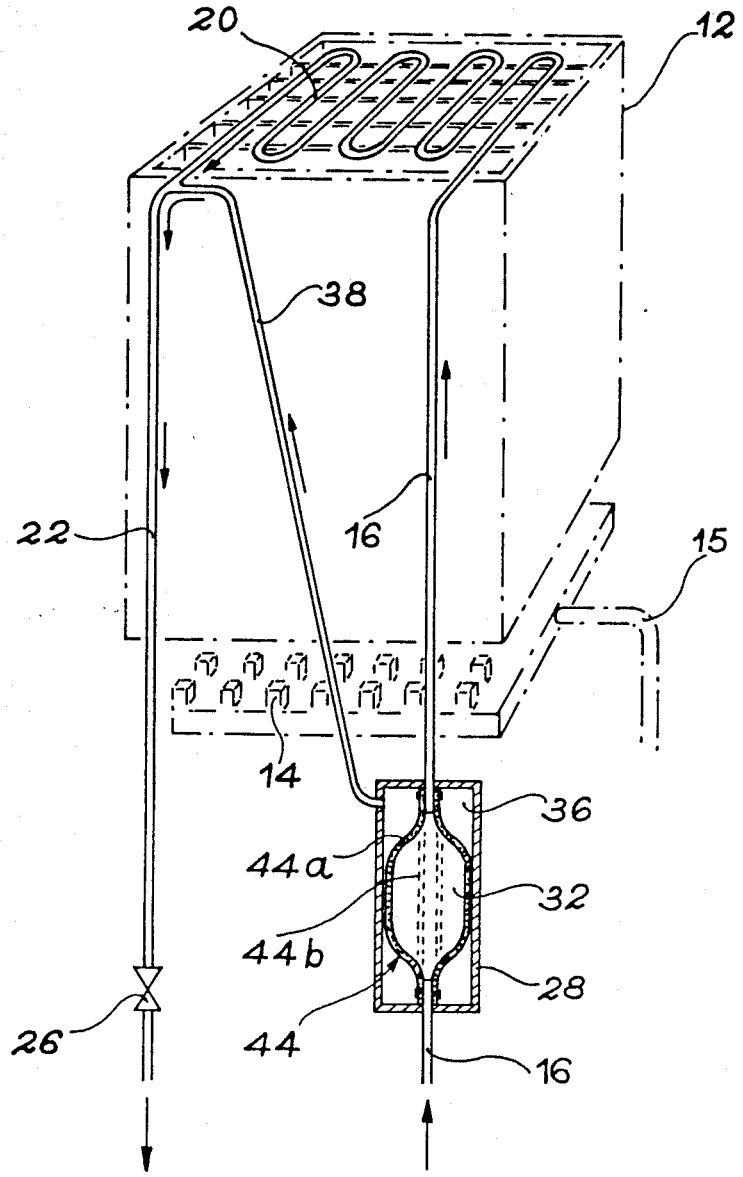

FIG. 5 A diagrammatic view illustrating the device according to the invention in the case where part of the cold fluid supply pipe is made from a flexible material.

Figure 6:
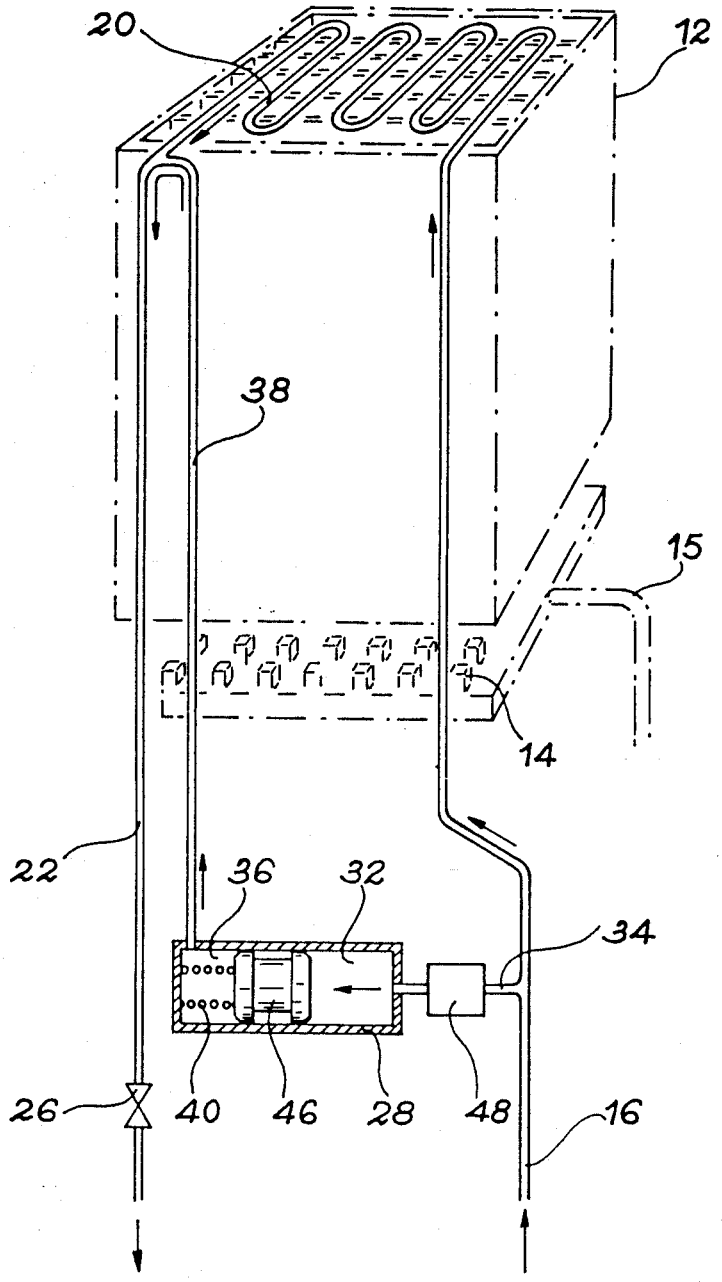

FIG. 6 A view similar to FIG. 5 illustrating the case where the displaceable element is a piston movable within a case.

On referring to FIGS. 3*a* and 3*b*, it is possible to see the cold water supply pipe 16, exchanger 20 and the hot water discharge pipe 22 equipped with a valve 26. For reasons of clarity, the combustion chamber and burners are not shown in FIGS. 3*a* and 3*b*.

The overheating and scaling control device according to the invention has a enclosure case 28 within which is located a deformable diaphragm 30 tightly fixed to the walls of said case. This diaphragm subdivides the case into a first compartment 32 communicating with pipe 16 by a tube 34 and a second compartment 36 communicating with the hot water discharge pipe 22 by a pipe 38. The latter issues into pipe 22 upstream of valve 26 with respect to the direction of flow of the water during the operation of the apparatus.

The device illustrated in FIGS. 3*a* and 3*b* functions as follows. FIG. 3a corresponds to the case where valve 26 is open and where the water circulates from pipe 16 to pipe 22 through an exchanger 20. Due to the fact that the water is moving, there is a pressure loss between the point where the tube 34 issues into pipe 16 and the point where tube 38 issues into pipe 22. Thus, the pressure is higher in pipe 16 than in pipe 22. It follows that the pressure is higher in compartment 32 of case 28 than in compartment 36 and consequently diaphragm 30 is displaced to the right on considering FIG. 3*a*.

FIG. 3*b* corresponds to the case where valve 26 is closed. As the water is no longer moving, the pressure is the same in pipes 16 and 22, as well as in exchanger 20. Thus, the pressures on either side of the diaphragm 30 are equal. As compartment 36 contains a spring 40 mounted so as to force diaphragm 30 to the left on considering FIGS. 3*a* and 3*b*, i.e. counter to the pressure prevailing in compartment 32 when valve 26 is closed, spring 40 expands and forces the diaphragm 30 to the left on considering these drawings. Thus, the water contained in compartment 32, which is cold water, is moved into exchanger 20 and the hot water contained in the latter is expelled through pipe 22 and tube 38 into compartment 36. The volume of the latter has been increased by the deformation of diaphragm 30 and can therefore receive said mass of water.

Thus, on stopping the apparatus, the hot water contained in the exchanger tube 20 is replaced by cold water. Thus, even if the walls of the combustion chamber are still hot, the temperature rise of the fluid contained in the exchanger 20 is limited and on starting up the heating apparatus again there is no risk of having an excessive temperature rise. In the preferred embodiment, the dimensions of case 28, as well as the shape and deformation characteristics of diaphragm 30 and the tension of spring 40 are determined in such a way that the water volume contained in compartment 32 in the situation of FIG. 3*a* is substantially equal to the water volume contained in exchanger 20.

FIG. 4 is a view similar to FIG. 3*a*, but in the present variant, the hot water discharge pipe 22 is not equipped with a valve such as valve 26 and is directly connected to the atmosphere. In this case, it is the pipe 16 which is equipped with a valve 42 upstream of the point at which tube 34 issues. Case 28 of FIG. 4 is like that of FIG. 3*a*. However, pipe 38 is eliminated and compartment 36 is directly linked with the atmosphere, e.g. by means of a perforation 43. FIG. 4 corresponds to the case where the apparatus is operating, i.e. valve 42 is open and water flows from pipe 16 to pipe 22. Due to pressure drops, the pressure of the water in pipe 16 and therefore in compartment 32 is higher than the pressure of the water at the outlet port 23 of pipe 22, which is equal to atmospheric pressure. Thus, diaphragm 30 is moved to the right on considering the drawing. When valve 42 is closed, the pressure is the same in pipe 16 downstream of the valve, as well as in exchanger 20 and pipe 22 and is equal to atmospheric pressure. Thus, spring 40 forces membrane 30 to the left on considering FIG. 4, which has the effect of expelling the cold water contained in compartment 32 into exchanger 20, whilst the hot water contained in the latter is discharged to the outside.

FIG. 5 diagrammatically shows in mixed line perspective form a water heater similar to that of FIG. 2 with tank 12 and burners 14 supplied by a pipe 15. There is also a cold water supply pipe 16, exchanger 20 in the upper part of tank 12 and the hot water discharge pipe 22 equipped with a valve 26. In this variant, part 44 of pipe 16 is made from a flexible material and constitutes a deformable diaphragm which can deform under the effect of the pressure differences between its first or inner face, which is in contact with the cold water, and its second or outer face. Case 28 surrounds part 44 of pipe 16 and is tightly fixed thereto. Thus, it is the interior of part 44 which constitutes the first compartment 32 and the volume between diaphragm 44 and case 28 which constitutes the second compartment 36. The latter is linked with the hot water discharge pipe 22 by a tube 38, which issues into pipe 22 at a point upstream of valve 26 and which can e.g. be located close to the outlet of exchanger 20 in the upper part of tank 12.

The operation of the device illustrated in FIG. 5 is substantially the same as that of the devices illustrated in FIGS. 3*a*, 3*b* and 4.

When valve 26 is open and water flows from pipe 16 to pipe 22 through exchanger 20, there is a pressure loss between part 44 of pipe 16 and pipe 22. The pressure of the water is consequently higher in part 44 of pipe 16 than in pipe 22. Therefore the diaphragm 44 swells and occupies the position 44a represented in continuous line form in FIG. 5. On closing valve 26, the water no longer flows and the pressure is the same in pipe 16, exchanger 20 and pipe 22. Thus, diaphragm 44 returns to its normal position **44*b* shown diagrammatically in broken line form in the drawing. This has the effect of discharging into exchanger 20 the cold water contained in compartment 32 and that part of the pipe 16 located between the latter and the exchanger, whilst the hot water contained in the exchanger is discharged along pipe 38 into compartment 36**.

Here again, it is possible to adopt a similar arrangement to that of FIG. 4, tube 38 and valve 26 being eliminated and compartment 36 being directly linked with the atmosphere.

FIG. 6 is a view similar to FIG. 5 but, in this variant, the displaceable element is constituted by a piston 46 mobile within case 28. As in FIG. 5, in mixed line form are shown the tank 12, burners 14 and gas supply pipe 15. There is also the cold water supply pipe 16, the exchanger tube 20 and the hot water discharge pipe 22 equipped with a valve 26. There is also case 28, but the deformable diaphragm is replaced by a piston 46 movable within said case. Once again there is the first compartment 32 communicating with pipe 16 by a tube 34 and the second compartment 36 communicating with pipe 22 by a tube 38, which issues into the latter at a point upstream of valve 26. It is once again possible to see spring 40 located in compartment 36 and positioned in such a way as to force the piston towards the right on considering FIG. 6.

This drawing corresponds to the case where valve 26 is open and consequently where the water flows from pipe 16 to pipe 22 through exchanger 20. In this case, the pressure in pipe 16 and therefore in compartment 32 exceeds the pressure prevailing in pipe 22 and therefore in compartment 36. Under the effect of this pressure difference, with the spring 40 being appropriately calibrated, piston 46 moves to the left on considering FIG. 6. When valve 26 is closed, the pressure is the same in pipe 16, exchanger 20 and pipe 22 and consequently it is the same in compartments 32 and 36. Under the action of spring 40, piston 46 moves to the right on considering the drawing and the cold water is discharged into tube 34 and pipe 16. This has the effect of discharging the hot water contained in exchanger 20 into tube 38 and from there into compartment 36.

In FIG. 6 it is also possible to see a diaphragm 48 placed on tube 34, said diaphragm serving to control the cold water flow.

For testing purposes a device in accordance with FIG. 6 was constructed and mounted on a water heater with a nominal power of 8.7 kW. The diaphragm 48 placed on tube 34 between pipe 16 and case 28 had a diameter of 4 mm. Case 28 was cylindrical and had a length of 150 mm and a diameter of 25 mm, the piston being 15 mm long. The spring used had a stiffness of 15 newtons per metre (N/m). The overheating measured on the apparatus not equipped with the device according to the invention was 31.5° C., whereas when using the device according to the invention, the maximum overheating was only 13° C.

Thus, the device according to the invention has particularly interesting advantages, the most important being that of reducing the temperature rise observed during the starting up of the heating apparatus. Moreover, as the temperature of the water contained in the exchanger is lower, this leads to a reduction of scale deposits in the exchanger and consequently brings about increased reliability and life of the apparatus.

Finally, it is obvious that the invention is not limited to the embodiments described and numerous variants can be envisaged without passing beyond the scope of the invention. Thus, any fluid heating apparatus (water heater, bath heater, gas boiler, etc.) can be equipped with an overheating and scaling control device according to the invention.

Furthermore, it is possible to use or not use a diaphragm like diaphragm 48 of FIG. 6 mounted on tube 34. Tube 34 can issue into pipe 16 at any random point thereof upstream of exchanger 20, provided that in cases similar to that of FIG. 4, where the pipe 22 communiates directly with the atmosphere, it issues downstream of valve 42. Tube 38 can issue into pipe 22 at any point downstream of exchanger 20, provided that said point is upstream of valve 26 in the case where the hot water discharge pipe is equipped with such a valve.

It is also pointed out that in most cases the cold water supply pipe 16 is equipped with a pressure reducing device (not shown in the drawings) used for controlling the combustible gas supply. Tube 34 can issue into pipe 16 both upstream and downstream of this pressure reducing device.

In the embodiments described hereinbefore, the variable volume enclosure is constituted by the first compartment of a case equipped either with a deformable diaphragm, or a mobile piston. In both cases, the second compartment can be linked either with the hot fluid discharge pipe, or with the atmosphere. Without passing beyond the scope of the invention, it would be possible to eliminate the second compartment of the case and limit the latter to the first compartment in the case where the second face of the diaphragm or piston is exposed to atmospheric pressure.

We claim:

1. Device for controlling overheating and scale formation for a fluid heater comprising a cold fluid supply pipe (16), a hot fluid discharge pipe (22) for discharging fluid for use, a control valve (26) in one of said pipes, an exchanger (20) having a fluid inlet connected in fluid communication with said cold fluid supply pipe and a fluid outlet connected in fluid communication with said hot fluid discharge pipe, said fluid circulating when the device is in operation from said supply pipe to said discharge pipe through said exchanger, a means for heating the fluid in said exchanger, a variable volume enclosure (28) having a displaceable element (30) therein connected in fluid communication with said cold fluid supply pipe, said displaceable element having a first face exposed to the pressure prevailing in the cold fluid supply pipe and a second face exposed to a reference pressure, a displacement means (40) mounted in said enclosure for displacing said displaceable element in a direction to reduce the volume of said variable volume disclosure, said displaceable element being moved, when said control valve is opened, under the effect of pressure in said cold fluid supply to occupy a first position in said enclosure permitting a volume of cold fluid to be stored in said enclosure that is substantially equal to the volume of said exchanger, and being moved, when said control valve is closed, under the effect of said reference pressure and displacement means, to a second position in said enclosure to force said stored volume of cold fluid in said enclosure through said exchanger so that the volume of fluid in said enclosure is minimal and residual heat in said exchanger will be absorbed to prevent overheating of said fluid in said exchanger.

2. Device according to claim 1, characterized in that said displaceable element is a deformable membrane or diaphragm (30).

3. Device according to claim 2, characterized in that part (44) of the cold fluid supply pipe (16) comprises a flexible material and thus constitutes the deformable diaphragm, said part (44) of the supply pipe constituting the variable volume enclosure (32).

4. Device according to claim 1, characterized in that said enclosure includes a case (28) and said displaceable element is a piston (46) mounted for reciprocal movement within said case.

5. Device according to claim 1, characterized in that the second face of the displaceable element is exposed to the pressure prevailing in the hot fluid discharge pipe (22).

6. Device according to claim 1, characterized in that the hot fluid discharge pipe (22) is directly linked with the atmosphere, so that the second face of the displaceable element (30) is exposed to atmospheric pressure.

7. Device according to claim 1, characterized in that said displacement means comprise a spring (40) having a first end fixed to said displaceable element (30) and a second end fixed to an immovable portion of said device.

8. Device for controlling overheating and scale formation for a fluid heating apparatus comprising an exchanger (20), a cold fluid supply pipe (16) connected to circulate cold fluid through said exchanger, a means for heating said fluid in said exchanger, a hot fluid discharge pipe (22) connected to said exchanger to carry hot fluid away from said exchanger, valve means (26, 42) mounted in one of said pipes and movable to an open position permitting said fluid circulation and a closed position stopping said fluid circulation, and wherein the improvement comprises a variable volume enclosure (28) having a displaceable element (30) mounted therein to divide said enclosure into first and second variable volume compartments (32, 36); a displacement means (40 or 44) for normally urging said displaceable element in a direction to minimize the volume of said first compartment; first conduit means (34) connecting said first compartment with said cold fluid supply pipe to admit fluid into said first compartment at a first pressure and second conduit means (38 or 43) connecting said second compartment to be at a second pressure corresponding to the pressure in said hot water discharge pipe, so that when said valve means is opened the force exerted by said first pressure in said first compartment will be higher than the combined force exerted by said displacement means and said second pressure in said second compartment to move said displaceable element and allow fluid to fill said first compartment, and when said valve means is closed the combined force exerted by said displacement means and said second pressure in said second compartment will be higher than the force exerted by said first pressure in said first compartment to move said displaceable element to froce cold fluid from said first compartment through said exchanger wherein it will absorb residual heat to prevent overheating of fluid retained in said exchanger.

* * * * *